United States Patent [19]

Cavrak

[11] 4,415,204

[45] Nov. 15, 1983

[54] EMERGENCY SYSTEM FOR MINES

[76] Inventor: Thomas Cavrak, R.D. #1, Box 77, Grindstone, Pa. 15442

[21] Appl. No.: 377,983

[22] Filed: May 13, 1982

[51] Int. Cl.[3] ..... E21C 41/00

[52] U.S. Cl. ..... 299/1; 340/310 A; 340/825.06; 405/303; 299/12; 299/19

[58] Field of Search ..... 299/1, 12, 18, 30; 405/303; 340/310 A, 825.06, 825.16, 825.23, 825.36, 825.37

[56] References Cited

U.S. PATENT DOCUMENTS

| | | | |
|---|---|---|---|
| 3,697,953 | 10/1972 | Schoenwitz | 340/825.16 |
| 3,925,763 | 12/1975 | Wadhwani et al. | 340/310 A |
| 3,949,353 | 4/1976 | Waters et al. | 299/12 X |
| 4,066,992 | 1/1978 | Buller et al. | 299/1 X |
| 4,102,394 | 7/1978 | Botts | 340/825.06 |
| 4,370,675 | 1/1983 | Cohn | 340/825.37 X |

*Primary Examiner*—Ernest R. Purser

*Attorney, Agent, or Firm*—Webb, Burden, Robinson & Webb

[57] ABSTRACT

An emergency communication system is provided in an underground mine having a plurality of locations capable of being mined. A cable extends from a central station to each of the mining locations. An emergency receiver ties into the cable located in each location and further connects to a load center which provides power to the mining equipment in that location. The emergency receiver further includes an alarm and an emergency switch and an oral communication system. A switchboard located at the central station is tied into the cable and is in independent signal communication with each location. The switchboard includes a power on/-off switch and an oral communication system for each location. Activation of the system by the dispatcher or operator in the central station, or activation by a miner within a mining location, automatically turns off the power from the load center to the mining equipment in that location. Independent oral communication is possible between each location of the mine crew and the central office.

4 Claims, 3 Drawing Figures

EMERGENCY SYSTEM FOR MINES

FIELD OF THE INVENTION

My invention relates to emergency systems for mines, and more particularly to an emergency system for deep mining, such as coal mining and the like.

DESCRIPTION OF THE PRIOR ART

Although the deep mining of minerals such as coal and the like is safer today than it was in the past, it remains an occupation having many inherent dangers. Failures in the mine exhaust system, fires and cave-ins are just three of the more prominent sources of problems which render mining inherently dangerous.

Present day emergency communication systems provide for all sections of the mine to be tied into a central dispatcher or operator station, which can be located inside or outside of the mine depending on the mine layout. This communication system consists of loudspeakers located in each section to permit the dispatcher or operator to talk to the miners all at the same time. The fans which provide fresh air to the various sections of the mine are also connected into a light display in the central station so that when any fan becomes inoperative, the dispatcher or operator immediately is advised and he in turn communicates to the section involved. However, all miners hear all communications and confusion often results where only a single location of the mine is involved.

The notification from the central office often causes panic within the individual sections and often locations in the mine not even remotely involved in the potential emergency get involved in responding back and forth with the dispatcher. The noise level is high from the mining equipment and roof bolters and it is often difficult to hear communications at all, let alone correctly. When the emergency or problem is solved, the dispatcher must again contact each section through the common communication system and work is again disrupted in areas not even remotely endangered by the problem or emergency.

More attention has been paid to devices which warn of a potential failure of a single problem such as mine roof warning devices, ventilation failure systems and the presence of explosive mixtures of gas. Representative of these systems are U.S. Pat. Nos. 3,111,655; 3,138,741; 3,949,353; 4,066,992; and 4,200,036.

SUMMARY OF THE INVENTION

My invention eliminates the confusion associated with a communication system which is common to all sections of the mine. In addition, my invention provides immediate notification to the sections of the mine involved and therefore eliminates the time lapse associated with a general communication system and a specific problem not applicable to all sections. Further my system automatically shuts off the mining equipment in the effected section, thereby allowing miners to hear the oral communications. Further by segmenting the communications the dispatcher or operator is better able to define the escape routes when it is necessary to evacuate certain sections of the mine.

My invention is a safety communication system which is normally a supplement to the existing system and includes a cable extending from a central station to each of the mine locations where crews of men work or may work. An emergency receiver is tied into the cable located in each location and is connected to the power load center for the miners and a receiver. The emergency receiver includes an alarm, an emergency switch and an oral communication system as well. A switchboard, located at the central station also ties into the cable in independent signal communication with each location. The switchboard includes a power on/off switch for each location and an oral communication system tied into the receiver of each location. Activation of the system by either the operator at the central station or mining personnel in a location of the mine automatically turns off the power to the mining equipment while at the same time sounding an alarm in the effected location.

DESCRIPTION OF THE PREFERRED EMBODIMENTS

Figure 1:
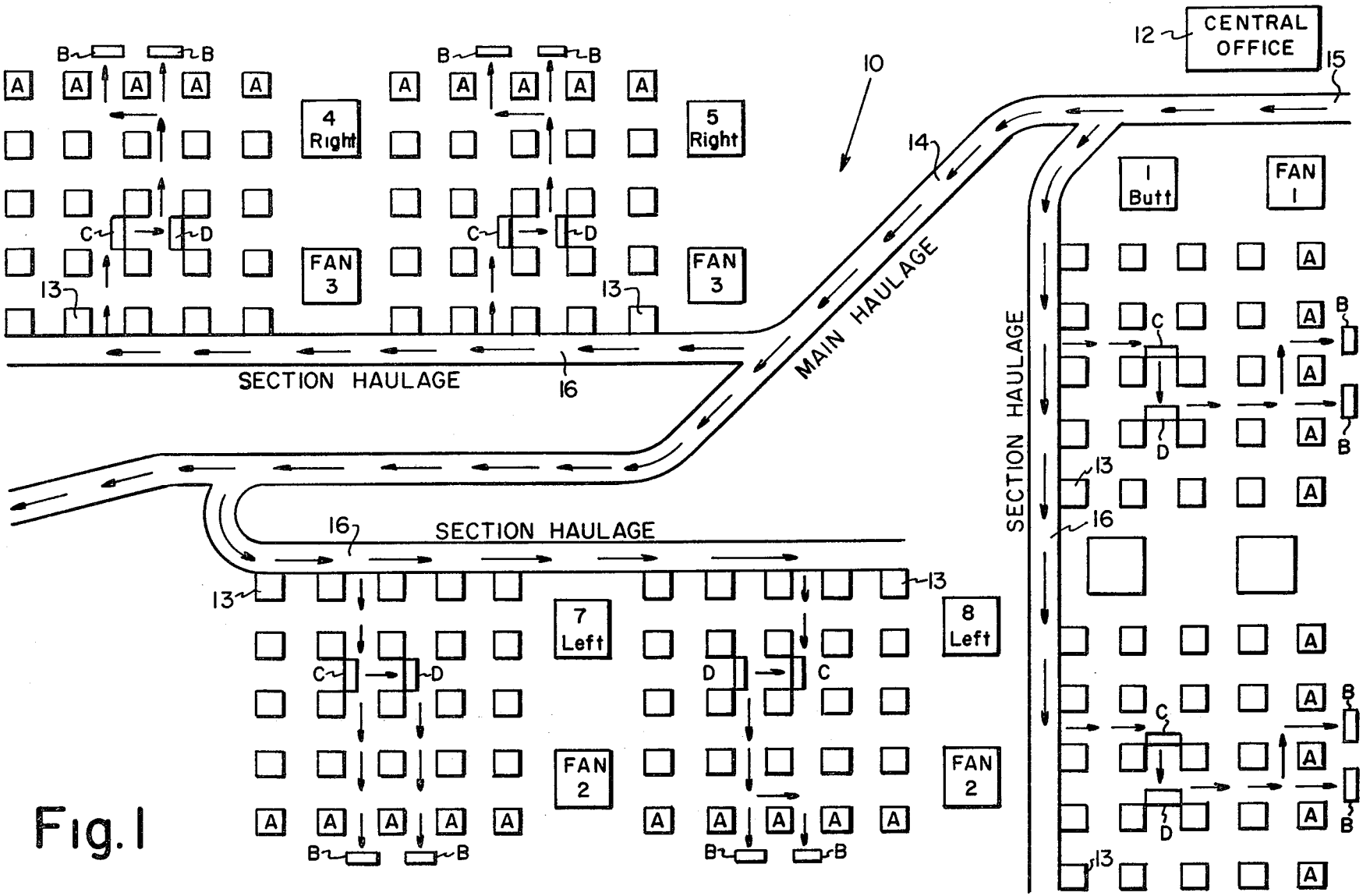
FIG. 1 is a schematic of a mine layout showing my emergency communication system.

My invention finds particular application to deep coal mining, but it could as well be applied to other types of mining in which there are a plurality of underground sections. A general layout, generally designated 10 of a portion of one form of a deep coal mine is illustrated in FIG. 1. For illustration purposes, three main sections are shown. It will be recognized that the illustration is directed to a portion of one type of mine layout, but the invention is equally applicable to the other types of mine layouts. Each section is divided into two locations and the sections and locations are identified as Section 1 butt, Section 2 butt, Section 4 right, Section 5 right, Section 7 left and Section 8 left, respectively. A main haulage line 14 generally runs from the main line opening or mouth 15 of the mine, throughout the length of the mine. Section haulage lines 16 extend off the main haulage line 14 and into the various locations to be mined.

An exhaust fan is provided for each main section of the mine. The normal exhaust fan is located on the surface and pulls fresh air from the mouth of the mine through the main haulage and into the various sections and locations. Other types of exhaust fans blow air rather than pull air. In the illustrated layout three fans, Fan 1, Fan 2 and Fan 3 are provided, with each fan pulling air into the two locations of each section of the mine. The fans generally utilize DC power from the electrical utility in the area.

As the mining takes place in each location pillars 13 of coal are left for roof supports. The pillars A at the face of the mine represent the area where the miners and roof bolters B operate. This face area is one of the most dangerous areas of the mine because of the collection of dust and the potential for accumulation of methane gas. The miners and roof bolters receive their power from a load center D at each location which normally provides AC power through power lines placed through bore holes in the ground.

The standard emergency syste comprises a two-wire cable (not shown) which extends throughout the main haulage line and connects to loudspeakers in each section which are hooked in common to the cable. The fans in turn are connected to light at a central dispatcher's office 12 so that when a fan shuts down for any reason, a light displays in the dispatcher's office 12 and the dispatcher utilizing the loudspeakers notifies the entire mine and the standard safety procedures are thereafter implemented. This central office may be located inside or outside of the mine and it may be a dispatcher or a chief operator who is located there depending on the type of mining involved.

In my emergency system, I provide separate lines for each location of the mine in which there is a working crew. These lines are illustrated by the arrows extending along the main haulage 14 and section haulages 16. These lines originate at an emergency switchboard 20 at the central office 12 and extend to emergency receivers C and the load centers D in each location of the mine.

Figure 2:
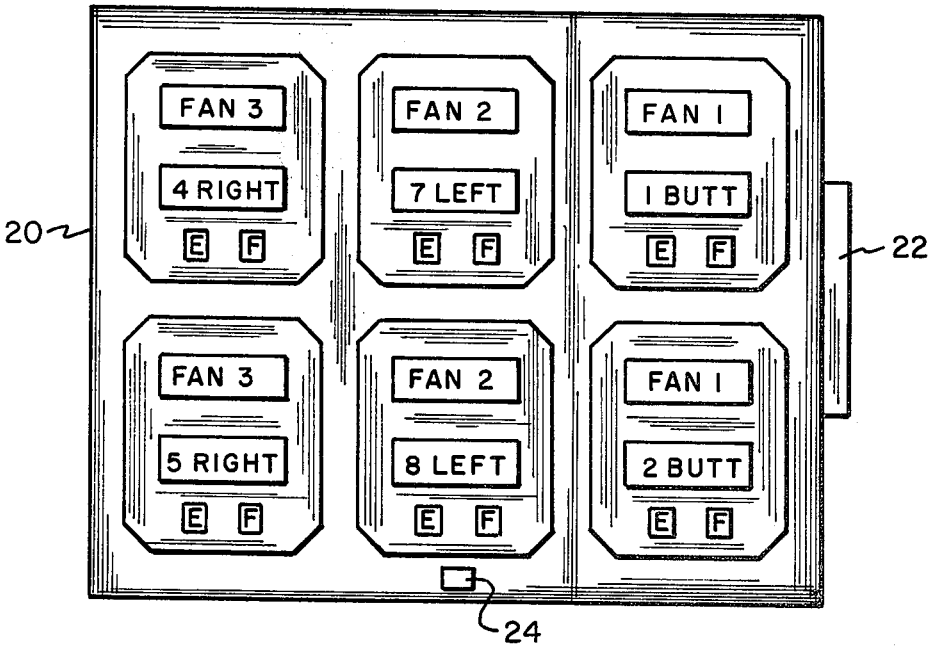
FIG. 2 is a schematic showing the emergency switchboard at the central location.

The switchboard 20 includes a panel displaying the identity of each of the fans and the individual locations and sections of the mine in which the fan is operative, FIG. 2. The switchboard 20 also includes a transmitter and receiver 22 and a hold button 24 so that locations may be put on hold while communications are transmitted to and from a single location at a time. Each location of the switchbard 20 has a power on switch E and a power off switch F which controls the power from the respective load center D to the miner and roof bolter B in that location. In practice the power on switch is a green button and the power off switch is a red button.

Figure 3:
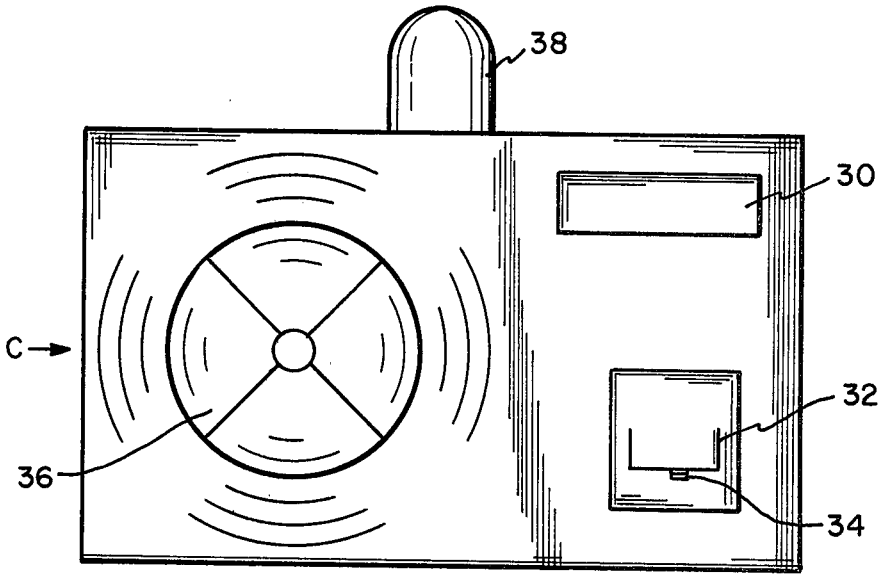
FIG. 3 is a schematic showing an emergency receiver in a section of the mine.

Each location of the mine which accommodates a crew of workers houses an emergency receiver C which includes a bell alarm 36, a light alarm 38, transmitter and receiver 30 and a main switch 32, FIG. 3. The main switch 32 further includes a button 34 which deactivates the bell alarm 36 so that verbal communications can be transmitted and received.

Both the emergency receover C in the mine locations and the emergency switchboard 20 in the dispatcher's office are wired through the load center D so that activation from either area immediately and automatically turns off the power to the miner and roof bolter.

The system will be explained for two different situations, one of which occurs external of the mine and the other internal of the mine.

Assume that due to an electrical storm the power has been disrupted to the No. 1 Fan thereby effecting locations 1 butt and 2 butt. The dispatcher will immediately activate the alarms and shut off all power to the miner and roof bolter located at the face of each location. He does so by simply pushing the red button on the switchboard in his office for the 1 butt location and the red button for the 2 butt location. Someone within each effected location will immediately pick up the receiver and be in oral communication with the dispatcher. The dispatcher then discusses what course of action should be taken. While the action is normally governed by Federal or State Law, there is generally a brief period of time, such as 15 minutes, where the miners remain in the location for certain types of emergencies. If the fan does not come back on within that time, the miners are asked to leave their location. Only the section and/or locations effected are notified thereby avoiding confusion in the other sections and locations. Of course, if the nature of the emergency is different, all the sections can be alerted at once using the standard emergency system. Because the miner and roof bolter are automatically shut off, the miners can hear the instructions from the dispatcher.

Where the emergency occurs within a section of the mine, the miner himself gets in touch with the dispatcher's office. The miner immediately goes to the emergency receiver in his section and hits the emergency alarm switch, which will automatically notify the dispatcher's office. The emergency alarm switch also sounds the alarm and the power to the miner and roof bolter is automatically shut off in that particular section. The dispatcher is then able to describe to the miners what alternatives should be taken, thereby cutting down on panic and confusion again. The miner has the button on the emergency alarm switch, which permits him to temporarily turn off the bell alarm so that he can complete is oral communication with the dispatcher.

My emergency system permits local problems to be solved locally without disrupting or causing confusion to the uneffected areas of the mine. All of this is done in supplement to the standard emergency procedures which can be effected in the event of major problems common to the entire mine.

I claim:

1. In an underground mine having a plurality of locations capable of being mined and including fans associated with locations for providing fresh air thereto, mining equipment operable at at least certain of said locations, a load center in each location for providing power to the mining equipment and a central dispatcher or operator station, the improvement comprising a safety communication system including:

A. a cable extending from the central station to each of the locations;

B. an emergency receiver tied into the cable in each location and connected to the load center, the receiver including an alarm, an emergency switch and an oral communication system; and C. a switchboard located at the central station and tied into the cable in independent signal communication with each location, the switchboard including a power on-off switch for each location and an oral communication system tied into the system of each location whereby an operator in the central station on the switchboard can selectively turn off and on power from the load center to the mining equipment in any given location while activating an alarm in that section, a mine personnel located in any given location can trip the emergency switch of the emergency receiver to activate the alarm and turn off power from the load center to the mining equipment in that given location and oral communication exists between the operator and each location.

2. The improvement of claim 1, said switchboard including a hold button to permit the operator to orally communicate with a location while keeping other locations in communication but on hold.

3. The improvement of claim 1, said alarm of the receiver including a sound alarm and a light alarm.

4. The improvement of claims 1, 2 or 3, each of said emergency receivers including an alarm stop button to permit the mine personnel to interrupt the alarm while orally communicating.

* * * * *